US005960884A

United States Patent [19]

Echols

[11] Patent Number: 5,960,884

[45] **Date of Patent: *Oct. 5, 1999**

[54] GRAVEL PACK APPARATUS

[75] Inventor: Ralph H. Echols, Dallas, Tex.

[73] Assignee: Halliburton Energy Services,Inc., Dallas, Tex.

[ * ] Notice: This patent is subject to a terminal disclaimer.

[21] Appl. No.: 09/086,614

[22] Filed: May 27, 1998

Related U.S. Application Data

[62] Division of application No. 08/605,601, Feb. 22, 1996, Pat. No. 5,810,084.

[51] Int. Cl.[6] ..... E21B 34/14

[52] U.S. Cl. ..... 166/317; 166/318

[58] Field of Search ..... 166/318, 242.6, 166/247.7, 317, 377

[56] References Cited

U.S. PATENT DOCUMENTS

| | | | |
|---|---|---|---|
| 2,843,399 | 7/1958 | Arterbury et al. | 285/3 |
| 3,747,700 | 7/1973 | Rilling | 175/323 |
| 3,945,446 | 3/1976 | Ostertag et al. | 175/323 |
| 3,997,006 | 12/1976 | Wetzel | 166/315 |
| 4,018,284 | 4/1977 | Perkins | 166/278 |
| 4,044,832 | 8/1977 | Richard et al. | 166/278 |
| 4,049,055 | 9/1977 | Brown | 166/278 |
| 4,246,968 | 1/1981 | Jessup et al. | 166/334 |
| 4,452,472 | 6/1984 | Crase | 285/3 |
| 4,497,371 | 2/1985 | Linsey, Jr. | 166/377 |
| 4,516,634 | 5/1985 | Ptts | 166/120 |
| 4,570,714 | 2/1986 | Turner et al. | 166/278 |
| 4,601,492 | 7/1986 | George | 285/3 |
| 4,628,993 | 12/1986 | Zunkel | 166/51 |
| 4,669,541 | 6/1987 | Bissonnette | 166/154 |
| 4,671,361 | 6/1987 | Bolin | 166/377 |
| 4,760,884 | 8/1988 | Haugen et al. | 166/377 |
| 4,770,336 | 9/1988 | Aterbury et al. | 166/227 |
| 4,815,540 | 3/1989 | Wallbillich, III | 166/377 |
| 4,856,591 | 8/1989 | Donovan et al. | 166/278 |
| 4,862,957 | 9/1989 | Scranton | 166/51 |
| 4,913,229 | 4/1990 | Hearn | 166/156 |
| 4,969,524 | 11/1990 | Whiteley | 166/278 |
| 4,984,632 | 1/1991 | Sampa et al. | 166/237 |
| 5,170,847 | 12/1992 | Mims et al. | 166/383 |
| 5,219,025 | 6/1993 | Berger et al. | 166/278 |
| 5,219,027 | 6/1993 | Taylor | 166/377 |
| 5,337,829 | 8/1994 | Taylor | 166/377 |
| 5,343,949 | 9/1994 | Ross et al. | 166/278 |
| 5,343,953 | 9/1994 | Patel et al. | 166/312 |
| 5,419,399 | 5/1995 | Smith | 166/377 |
| 5,526,888 | 6/1996 | Gazewood | 175/320 |
| 5,718,291 | 2/1998 | Lorgen et al. | 166/377 |

*Primary Examiner*—Hoang C. Dang
*Attorney, Agent, or Firm*—Paul I. Herman; Marlin R. Smith

[57] ABSTRACT

A gravel pack apparatus and associated method of completing subterranean wells provides convenient and economical gravel packing operations, permitting a sand control screen to be run into the well attached to the apparatus which is, in turn, attached to production tubing, and further permitting the tubing to be detached from the screen. In a preferred embodiment, a gravel pack apparatus has interoperable valve and tubing release portions. The valve portion may be closed after the gravel packing operation is completed. Closure of the valve portion activates the release portion, permitting the apparatus to be separated.

25 Claims, 7 Drawing Sheets

FIG. 2A
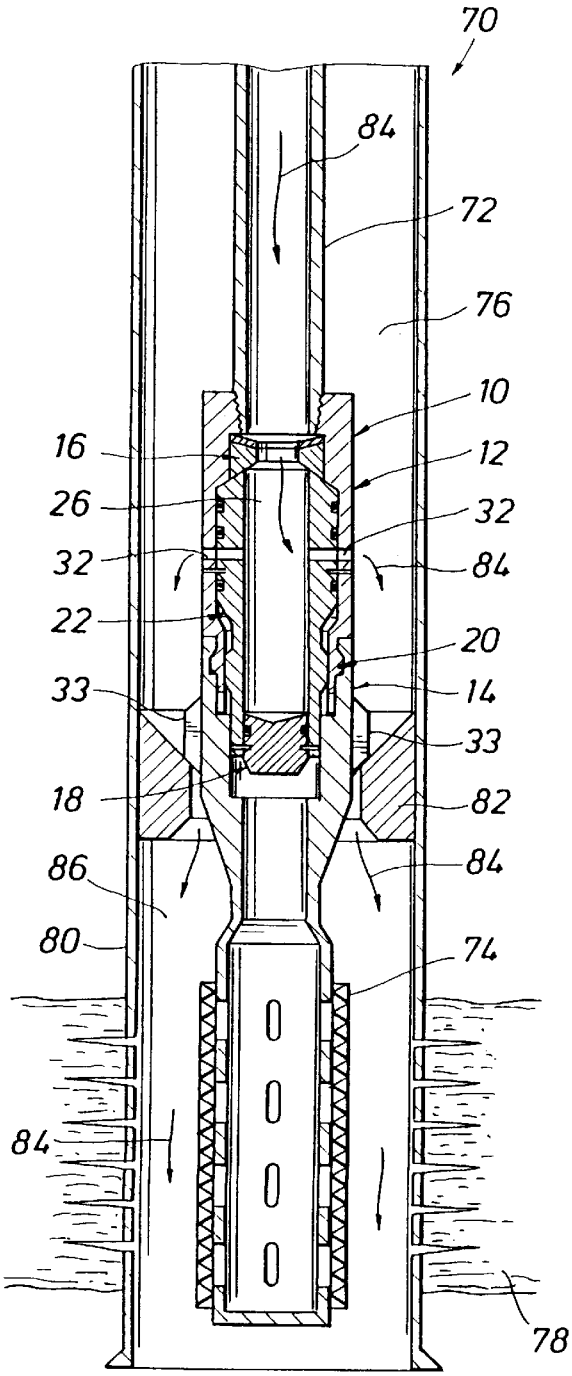
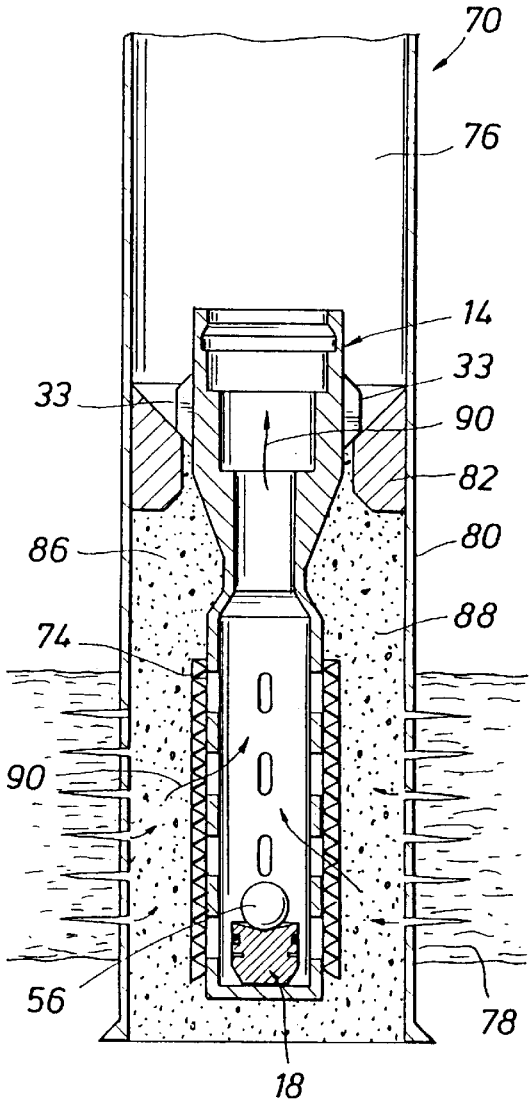
FIG. 2B

GRAVEL PACK APPARATUS

This is a division of application Ser. No. 08/605,601, filed Feb. 22, 1996, now U.S. Pat. No. 5,810,084, such prior application being incorporated by reference herein in its entirety.

BACKGROUND OF THE INVENTION

The present invention relates generally to tools used to complete subterranean wells and, in a preferred embodiment thereof, more particularly provides apparatus for use in gravel pack operations and methods of using same.

Gravel pack operations are typically performed in subterranean wells to prevent fine particles of sand or other debris from being produced along with valuable fluids extracted from a geological formation. If produced (i.e., brought to the earth's surface), the fine sand tends to erode production equipment, clog filters, and present disposal problems. It is, therefore, economically and environmentally advantageous to ensure that the fine sand is not produced.

In the subterranean well, a tubular protective casing usually separates the formation containing the fine sand particles from the wellbore. The casing is typically perforated opposite the formation to provide flowpaths for the valuable fluids from the formation to the wellbore. If production tubing is simply lowered into the wellbore and the fluids are allowed to flow directly from the formation, into the wellbore, and through the production tubing to the earth's surface, the fine sand will be swept along with the fluids and will be carried to the surface by the fluids.

Conventional gravel pack operations prevent the fine sand from being swept into the production tubing by installing a sand screen on the end of the production tubing. The wellbore in an annular area between the screen and the casing is then filled with a relatively large grain sand (i.e., "gravel"). The gravel prevents the fine sand from packing off around the production tubing and screen, and the screen prevents the large grain sand from entering the production tubing.

A problem, which is present in every conventional gravel pack operation, is how to place the gravel in the annular area between the screen and the casing opposite the formation. If the screen is merely attached to the bottom of the production tubing when it is installed in the wellbore, the gravel cannot be pumped down the production tubing because the screen will prevent it from exiting the tubing. The gravel cannot be dropped into the wellbore annular area from the earth's surface because a packer is usually installed between the production tubing and the casing above the formation, and this method would be very inaccurate in packerless completions as well.

One solution has been to run the production tubing into the wellbore without the screen being attached to the tubing. A landing nipple is installed at or near the bottom of the tubing before running the tubing into the well. When the landing nipple has been properly positioned above the formation, a screen is lowered into the tubing from the earth's surface on a slickline or wireline. The screen is landed in the nipple in the tubing so that it extends outwardly and downwardly from the tubing and is positioned opposite the formation. Gravel is then pumped down the tubing from the earth's surface, through a small space between the nipple and the screen, and outwardly into the annular area between the screen and the casing opposite the formation. This method is known as "through tubing gravel packing", since the gravel is pumped through the tubing.

This method has several disadvantages, however. One disadvantage is that the screen must be installed into the tubing as a separate operation. This requires coordination with a slickline or wireline service, time spent rigging up and rigging down special equipment such as lubricators needed for these operations, and the inability to conveniently perform such operations in wells which are horizontal or nearly horizontal. In some instances, the screen is run in with the tubing, already landed in the nipple in the tubing. In those instances, a slickline operation is still needed to retrieve the screen from the tubing.

Another disadvantage of the above method is that the screen must be able to pass through the tubing. This means that the size of the screen (at least its outer diameter) can be no larger than the tubing's inner drift diameter. In order to have a sufficiently large screen surface area, very long screens must sometimes be utilized with this method. Additionally, since there is usually only a very small radial gap between the screen (or the slickline tool used to place the screen in the nipple) and the landing nipple, only a very small flow area is available for pumping the gravel out of the tubing and into the annular area of the well.

Yet another disadvantage of the above method is that the tubing may not be conveniently removed from the wellbore for replacing the packer, completing other formations in the well, maintenance, etc. The method requires the screen to be removed along with the tubing, or the screen must be removed by wireline or slickline prior to removing the tubing. In either case, the gravel pack will be destroyed as the gravel falls into the void created when the screen is removed.

From the foregoing, it can be seen that it would be quite desirable to provide apparatus for gravel pack operations which does not require the screen to be positioned as a separate operation and does not require the screen to pass through the tubing, but which provides a large flow area for pumping the gravel into the annular area of the well and provides for convenient detachment of the tubing from the screen for removal of the tubing from the wellbore. It is accordingly an object of the present invention to provide such apparatus and associated methods of using same.

SUMMARY OF THE INVENTION

In carrying out the principles of the present invention, in accordance with an embodiment thereof, gravel pack apparatus is provided which is a unique valve and release mechanism. The valve permits pumping gravel therethrough with the screen attached to the bottom of the tubing, and the release mechanism permits convenient detachment of the tubing from the screen.

In broad terms, apparatus is provided which includes tubular first and second housings, a ball seat, a plurality of collets, a flow passage and a tubular sleeve. The second housing is coaxially disposed relative to the first housing, with an end of the first housing being proximate an end of the second housing. The flow passage extends through the first and second housings.

The collets extend axially between the first housing and the second housing and releasably secure the first housing against axial displacement relative to the second housing. The tubular sleeve is coaxially disposed within the first and second housings and has an outer diameter radially inwardly adjacent the collets. The sleeve outer diameter radially outwardly biases the collets, and the sleeve is disposed adjacent the ball seat, such that the sleeve is capable of axial movement relative to the collets when a pressure differential is created across the ball seat.

Additionally, apparatus is provided which includes tubular first and second housings, a ball seat, a lug, a flow passage, and a tubular sleeve. The flow passage extends through the first and second housings.

The first housing has an end portion and a radially extending opening formed through the end portion. The second housing has an end portion radially outwardly and coaxially disposed relative to the first housing end portion.

The lug extends radially through the opening and between the first housing end portion and the second housing end portion. The lug releasably secures the first housing against axial displacement relative to the second housing.

The tubular sleeve is coaxially disposed within the first housing. It has an outer diameter radially inwardly adjacent the lug which radially outwardly biases the lug. The sleeve is disposed adjacent the ball seat, such that the sleeve is capable of axial movement relative to the lug when a pressure differential is created across the ball seat.

A method of completing a subterranean well having a wellbore intersecting a formation is also provided, which method includes the steps of providing a gravel pack device, providing production tubing, attaching the gravel pack device to the production tubing, and inserting the gravel pack device and production tubing into the wellbore.

The gravel pack device includes first and second tubular housings, a collet member releasably securing the first tubular housing in a coaxial and adjoining relationship with the second tubular housing, an expandable circumferential seal surface, an internal flow passage extending axially through the seal surface and the first housing, and a tubular sleeve having an outer side surface. The tubular sleeve has a first position, in which the sleeve outer side surface radially biases the collet member to secure the first and second housings against axial displacement therebetween, and a second position, axially displaced relative to the collet member from the first position, in which the sleeve outer side surface unbiases the collet member to release the first and second housings for axial displacement therebetween.

The seal surface is capable of biasing the sleeve to axially displace from the first position to the second position when a pressure differential is created across the seal surface. The method also includes the steps of creating the pressure differential across the seal surface and releasing the first and second housings for axial displacement therebetween.

Additionally, a method of gravel packing a formation intersected by a subterranean wellbore is also provided. The method includes the steps of providing a device, production tubing, and a sand control screen, attaching the device between the tubing and the sand control screen, and inserting the tubing, device, and sand control screen into the wellbore.

The device includes first and second tubular housings, a ball seat, collets, a flow passage, a plug releasably secured in the flow passage, a flow port, and a tubular sleeve. The second housing is coaxially disposed relative to the first housing with an end of the first housing being proximate an end of the second housing. The ball seat is coaxially disposed within the first housing. The flow port is capable of permitting fluid communication between the flow passage and the wellbore.

The collets extend axially between the first housing end and the second housing end and releasably secure the first housing against axial displacement relative to the second housing. The sleeve is coaxially disposed within the first and second housings and has an outer diameter radially inwardly adjacent the collets. The sleeve outer diameter radially outwardly biases the collets, and the sleeve is disposed adjacent the ball seat, such that the sleeve is capable of axial movement relative to the flow port and the collets when a first predetermined pressure differential is created across the ball seat. The plug is capable of being expelled from the flow passage when a second predetermined pressure differential is created across the plug.

The method further includes the steps of positioning the sand control screen in a predetermined axial position in the wellbore relative to the formation and forcing a gravel pack slurry through the production tubing, into the flow passage, through the flow port, into the wellbore, and into an annular area radially intermediate the sand control screen and the formation. The first predetermined pressure differential is created across the ball seat by sealingly engaging a ball with the ball seat and applying pressure to the production tubing. The second predetermined pressure differential is created across the plug by applying pressure to the production tubing after the first predetermined pressure differential is created.

The use of the disclosed apparatus and methods of using same permits larger screens to be used in through-tubing gravel pack operations, provides larger flow areas through which to pump the gravel, eliminates separate screen installation and removal by wireline or slickline operations, and permits convenient removal of the tubing while the screen and gravel pack remain undisturbed in the well.

BRIEF DESCRIPTION OF THE DRAWINGS

FIGS. 2A–2B are highly schematicized cross-sectional views of a method embodying principles of the present invention, using the first apparatus;

DETAILED DESCRIPTION

The following descriptions of preferred embodiments of the present invention describe use of the embodiments in gravel packing operations in subterranean wellbores. It is to be understood, however, that apparatus and methods embodying principles of the present invention may be utilized in other operations, such as fracturing or acidizing operations.

Figure 1A:
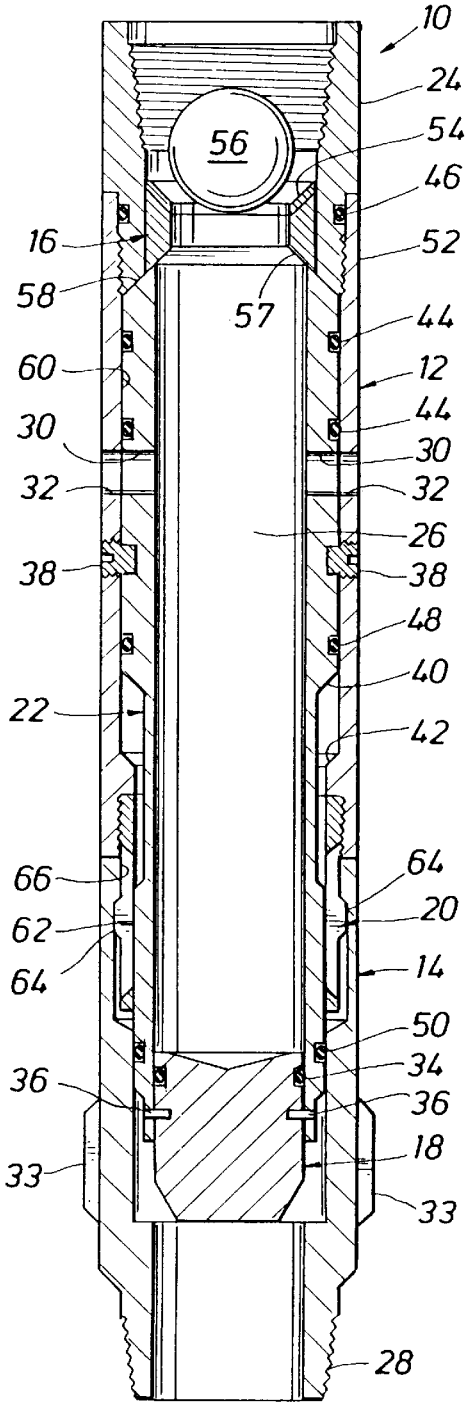
FIGS. 1A–1B are cross-sectional views of a first apparatus embodying principles of the present invention.
Figure 1B:
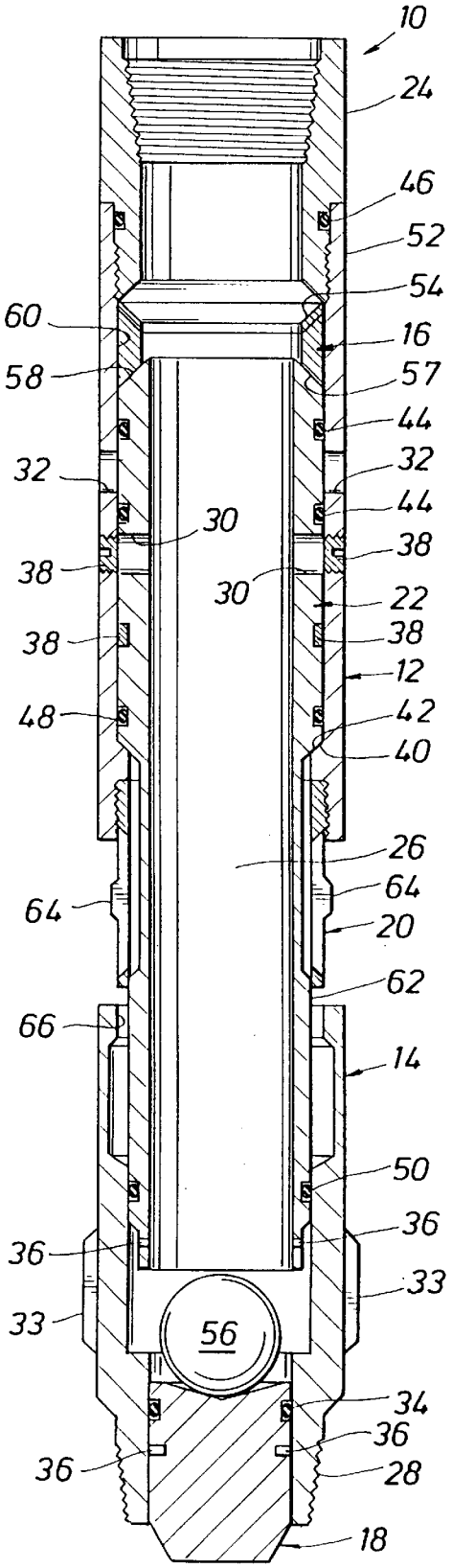

Illustrated in FIGS. 1A and 1B is a gravel pack apparatus 10 which embodies principles of the present invention. In the following detailed description of the apparatus 10 representatively illustrated in FIGS. 1A and 1B, and subsequent apparatus, methods, and figures described hereinbelow, directional terms such as "upper", "lower", "upward", "downward", etc. will be used in relation to the apparatus 10 as it is depicted in the accompanying figures. It is to be understood that the apparatus 10 and subsequent apparatus and methods described hereinbelow may be utilized in vertical, horizontal, inverted, or inclined orientations without deviating from the principles of the present invention.

The apparatus 10 includes a tubular upper housing 12, a tubular lower housing 14, an expandable ball seat 16, a plug 18, collets 20, and a tubular sleeve 22. FIG. 1A shows the apparatus 10 in a configuration in which it is run into the wellbore prior to the gravel pack operation. FIG. 1B shows the apparatus 10 in a configuration subsequent to the gravel pack operation. Comparing FIG. 1B to FIG. 1A, note that the expandable ball seat 16 has expanded radially outward within the upper housing 12, the sleeve 22 has been shifted downward within the upper housing, the plug 18 has been ejected out of the sleeve, and the lower housing 14 has separated from the upper housing 12.

When initially run into the wellbore prior to the gravel pack operation, as shown in FIG. 1A, the apparatus 10 is installed between the production tubing and the sand control screen (not shown in FIGS. 1A and 1B). The tubing is threadedly and sealingly attached to the upper housing 12 at upper connector 24. An interior axial flow passage 26 is thus placed in fluid communication with the interior of the production tubing. The screen is threadedly and sealingly attached to the lower housing 14 at lower end 28. Plug 18 in sleeve 22 prevents fluid communication between the interior of the production tubing and the interior of the screen via the flow passage 26.

Plug 18 prevents gravel, pumped down the tubing from the earth's surface, from filling the interior of the sand screen during the gravel pack operation. The plug 18 is later ejected, as shown in FIG. 1B, to permit flow of fluids from the interior of the screen, through the flow passage 26, and into the production tubing for transport to the earth's surface. A circumferential seal 34 sealingly engages the plug 18 and sleeve 22 and permits a pressure differential to be created across the plug to shear shear pins 36 which extend radially through the sleeve 22 and into the plug.

Radially extending ports 30 on the sleeve 22 are initially aligned with radially extending ports 32 on the upper housing 12, permitting fluid communication between the flow passage 26 and the wellbore external to the apparatus 10. During the gravel pack operation, gravel may be pumped through the ports 30 and 32 and into the annular area between the screen and the casing. Radially extending and circumferentially spaced splines 33 formed on lower housing 14 permit fluid flow longitudinally between the wellbore external to the upper housing 12 and the wellbore below the lower housing as further described below.

The aligned relationship of the ports 30 and 32 is releasably secured by shear pins 38 threadedly installed radially through the upper housing 12 and into the sleeve 22. When shear pins 38 are sheared, sleeve 22 is permitted to move downwardly until radially sloping shoulder 40 on the sleeve 22 contacts radially sloping shoulder 42 on the upper housing 12.

When sleeve 22 has been downwardly shifted, as shown in FIG. 1B, circumferential seals 44, which sealingly engage the sleeve and upper housing 12, straddle the ports 32 on the upper housing 12 and prevent fluid communication between the flow passage 26 and the wellbore external to the apparatus 10. Circumferential seals 46, 48, and 50 sealingly engage the upper connector 24 and an upper end 52 of the upper housing 12, the sleeve 22 and the upper housing, and the sleeve and the lower housing 14, respectively, also preventing fluid communication between the flow passage 26 and the wellbore external to the apparatus 10.

Sleeve 22 is downwardly shifted within the upper housing 12 by the expandable ball seat 16. The expandable ball seat 16 is of conventional construction and is in a radially compressed configuration, as viewed in FIG. 1A, when installed into the upper connector 24. Upwardly facing seal surface 54 on the ball seat 16, when in the radially compressed configuration, is smaller in diameter than, and is thus capable of sealingly engaging, a ball 56 dropped or pumped down through the production tubing. It is to be understood that the ball 56 would preferably not be dropped through the production tubing during the gravel pack operation as it would interfere with the pumping of gravel through the apparatus 10. The ball 56 is preferably dropped through the production tubing when the gravel pack operation has been completed and it is desired to shift the sleeve 22 to close ports 32.

When the ball 56 sealingly engages the seal surface 54, a pressure differential may be created across the ball seat 16 by applying pressure to the interior of the production tubing at the earth's surface. Such a pressure differential downwardly biases the ball seat 16 against the sleeve 22, forcing radially sloping surface 57 on the ball seat 16 against radially sloping surface 58 on the sleeve. The contact between the sloping surfaces 57 and 58 further biases the ball seat 16 radially outward.

When sufficient pressure differential has been created across the ball seat 16, shear pins 38 shear, permitting the sleeve 22 to downwardly shift, as described above, and permitting the ball seat 16 to expand radially outward into radially enlarged inner diameter 60 within the upper housing 12. Such expansion of the ball seat 16 causes the seal surface 54 to have an inner diameter larger than that of the ball 56, which permits the ball to pass through the ball seat and the flow passage 26 to the plug 18. Thus, when the plug 18 is later expelled from the sleeve 22, as shown in FIG. 1B and described above, the ball 56 will also be expelled.

Lower housing 14 is initially coaxially attached to the upper housing 12, as shown in FIG. 1A, with collets 20 which are threadedly installed onto the upper housing. Radially enlarged outer diameter 62 on the sleeve 22 biases the collets 20 radially outward so that radially extending projections 64 on the collets are radially larger than reduced inner diameter 66 on the lower housing 14. When, however, the sleeve 22 has been downwardly shifted, as shown in FIG. 1B, the collets 20 are no longer radially outwardly biased by diameter 62 on the sleeve, and the collets are permitted to flex radially inward. Inner diameter 66 on the lower housing 14 may then pass over the projections 64, permitting the lower housing to separate from the upper housing 12.

In a preferred mode of operation, the apparatus 10 is installed between the production tubing and the sand control screen as described above. During the gravel pack operation, gravel is pumped down through the tubing and into flow passage 26. The gravel exits through the aligned ports 30 and 32 and flows into the wellbore. When the gravel pack operation is completed, the ball 56 is dropped or pumped down through the tubing to the ball seat 16. Pressure is applied to the tubing at the surface until a first predetermined pressure differential is created across the ball seat 16, shearing the shear pins 38 and forcing the sleeve 22 to shift downward. At this point, ports 32 are closed, preventing fluid communication between the wellbore and the flow passage 26, and collets 20 are no longer biased radially outward. The ball 56 passes through the ball seat 16. A second predetermined pressure differential is then created across the plug 18 by applying pressure to the tubing at the earth's surface, thereby shearing shear pins 36, and expelling the plug 18 and the ball 56 from the sleeve 22. The tubing may be removed from the wellbore when desired, without displacing or otherwise disturbing the screen or gravel pack.

Turning now to FIGS. 2A and 2B, a method 70 of using the apparatus 10 is representatively illustrated. It is to be understood that, with suitable modifications, other apparatus may be utilized in method 70, including other apparatus described hereinbelow, without departing from the principles of the present invention.

FIG. 2A shows the apparatus 10 operatively installed between production tubing 72, which extends to the earth's surface and is attached to the upper housing 12, and sand control screen 74. The screen 74, apparatus 10, and tubing 72 are lowered into wellbore 76, which intersects formation 78 and is lined with protective casing 80. A conventional tubing hanger 82 has previously been set in the casing 80 a predetermined distance above the formation 78. As the screen 74, apparatus 10, and tubing 72 are lowered into the wellbore, splines 33 on the lower housing 14 engage the tubing hanger 82, thereby positioning the screen 74 in the wellbore 76 opposite the formation 78. Alternatively, splines 33 could engage, for example, a nipple (not shown) disposed in a string of production tubing (not shown), or the nipple could be suspended from a packer (not shown) set in the casing 80.

A gravel pack slurry 84 is then pumped down the tubing 72 from the earth's surface. The slurry 84 enters the flow passage 26 of the apparatus 10 and then exits the apparatus through open ports 32. The slurry 84 then flows downwardly in the wellbore 76 and passes between the splines 33 and the tubing hanger 82. From the tubing hanger 82, the slurry 84 enters an annular area 86 below the tubing hanger and radially intermediate the screen 74 and the casing 80.

Slurry 84 is pumped into the annular area 86 until it forms a gravel pack 88 as shown in FIG. 2B. The ball 56 is then dropped or pumped down the tubing 72, the ball sealingly contacting the ball seat 16. Pressure is applied to the tubing 72 to shift the sleeve 22 downward and close ports 32 as described above. The collets 20 are also no longer biased radially outward after the sleeve 22 is downwardly shifted, but the upper housing 12 is not yet separated from the lower housing 14.

Pressure is again applied to the tubing 72 to expel the plug 18 and ball 56 from the sleeve 22 as described above. The plug 18 and ball 56 then drop into the screen 74 as shown in FIG. 2B. At this point the tubing 72 is in fluid communication with the screen 74 and fluids 90 may flow from the formation 78, through the gravel pack 88 in the annular area 86, through the screen 74, through the flow passage 26 of the apparatus 10, and upwardly through the tubing 72 to the earth's surface.

If desired, the tubing 72 may be conveniently removed from the wellbore 76 by raising the tubing to separate the upper housing 12 from the lower housing 14. The lower housing 14 remains in the wellbore 76, supporting the screen 74 opposite the formation 78 in the gravel pack 88 as shown in FIG. 2B. The screen 74 and gravel pack 88 are not disturbed when the tubing 72 is removed from the wellbore 76.

Note that, in the above-described method 70, screen 74 is not required to pass through the tubing 72 and, therefore, has an outer diameter which is limited only by the casing 80 or tubing hanger 82. Note also, that a relatively large flow area is available for slurry 84 to flow between the lower housing 14 and the tubing hanger 82 via the splines 33. Additionally, no separate wireline or slickline operation is needed in method 70 to position or remove the screen 74.

Figure 3A:
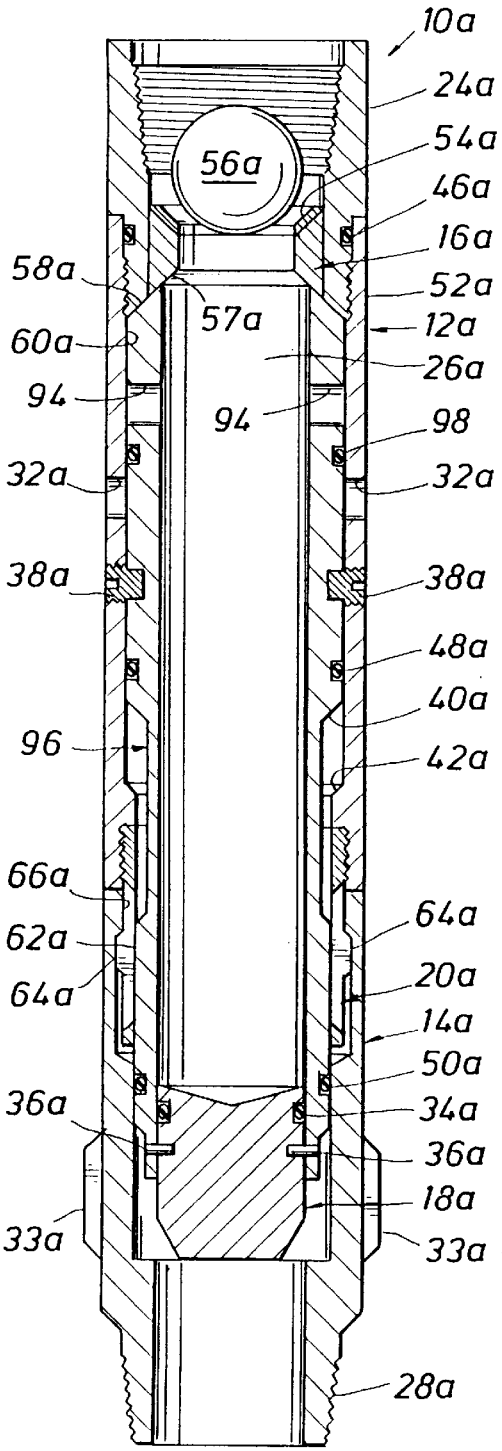
FIGS. 3A–3B are cross-sectional views of a second apparatus embodying principles of the present invention.
Figure 3B:
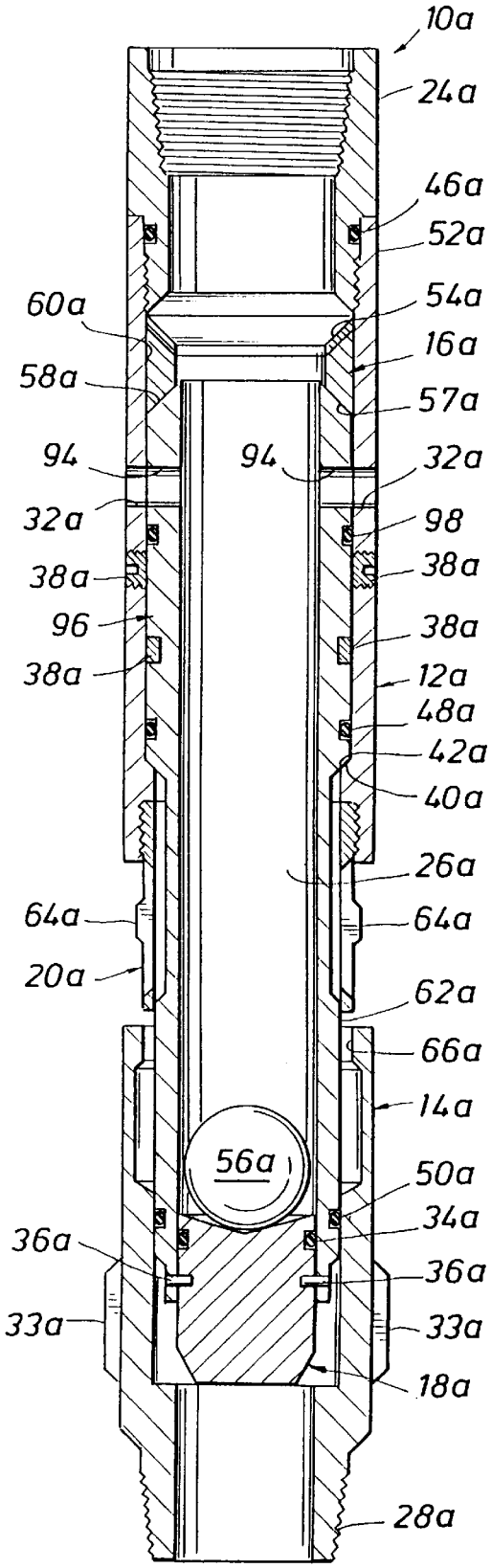

Turning now to FIGS. 3A and 3B, an apparatus 10*a* is shown which is a modified form of the apparatus 10 shown in FIGS. 1A–2B. Elements of apparatus 10*a* which are similar to those elements previously described are indicated in FIGS. 3A and 3B with the same reference numerals, but with an added suffix "a".

Apparatus 10*a* functions similar to apparatus 10, the major difference being that ports 32*a* are initially closed, as shown in FIG. 3A. Ports 32*a* are axially displaced from ports 94 on sleeve 96. Circumferential seal 98 sealingly engages the sleeve 96 and upper housing 12*a* and is disposed axially intermediate ports 94 and 32*a,* thereby preventing fluid communication between the ports.

When the sleeve 96 is downwardly shifted, as shown in FIG. 3B, ports 94 and 32*a* are aligned and fluid communication is established between the flow passage 26*a* and the wellbore external to the apparatus 10*a*. It will be readily appreciated by one skilled in the art that if the flow passage 26*a* is in fluid communication with the wellbore and the interior of lower end 28*a* is in fluid communication with the wellbore, a pressure differential cannot be created across the plug 18*a* to expel the plug and ball 56*a* from the sleeve 96. Thus, if the plug 18*a* is desired to be expelled from the sleeve 96 of apparatus 10*a* by pressure differential created across the plug, a means, such as gravel pack 88 (see FIG. 2B), to restrict fluid communication between the flow passage 26*a* and the interior of the lower end 28*a* via the wellbore must be utilized.

Thus, apparatus 10*a* is useful in circumstances in which it is desired to run the apparatus into the wellbore with ports 32*a* initially closed. The ports 32*a* may then be opened by dropping or pumping ball 56*a* down the tubing and applying a predetermined pressure to shear shear pins 38*a* and downwardly shift the sleeve 96.

When sleeve 96 has been shifted downward, ports 32*a* and 94 are aligned and permit flow therethrough, and collets 20*a* are no longer radially outwardly biased by enlarged outer diameter 62*a*. The upper housing 12*a* may then be separated from lower housing 14*a,* and, if a means to seal flow passage 26*a* against fluid communication with lower end 28*a* has been utilized, the ball 56*a* and plug 18*a* may be expelled from the sleeve 96 by applying a second pressure differential to shear shear pins 36*a*.

Figure 4A:
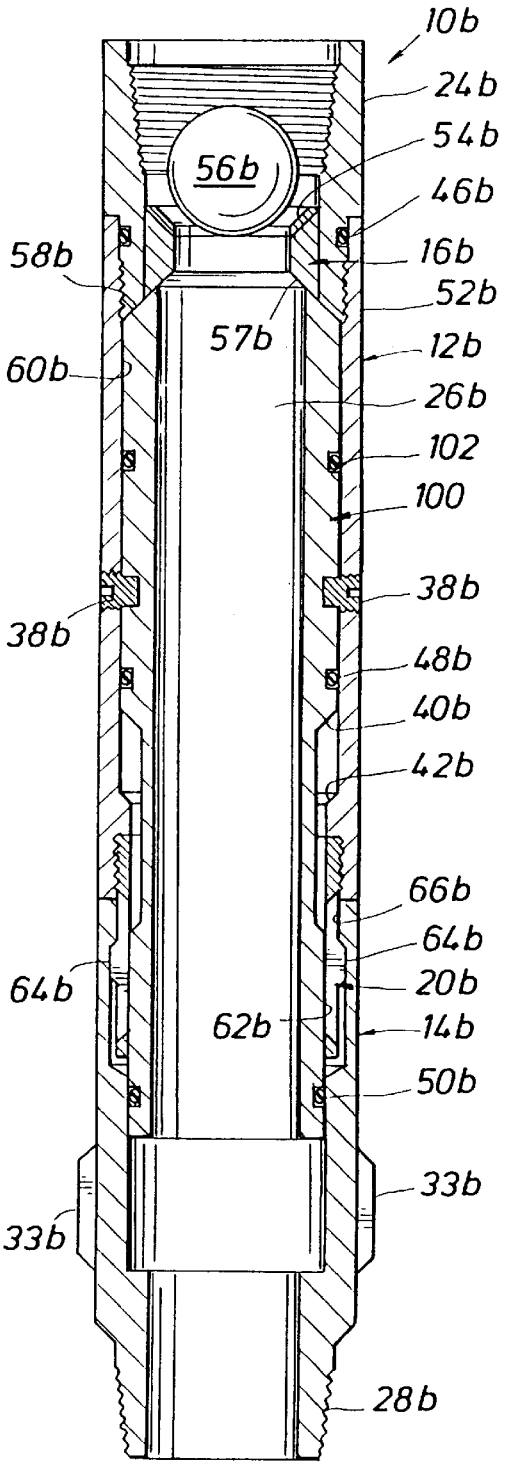
FIGS. 4A–4B are cross-sectional views of a third apparatus embodying principles of the present invention.
Figure 4B:
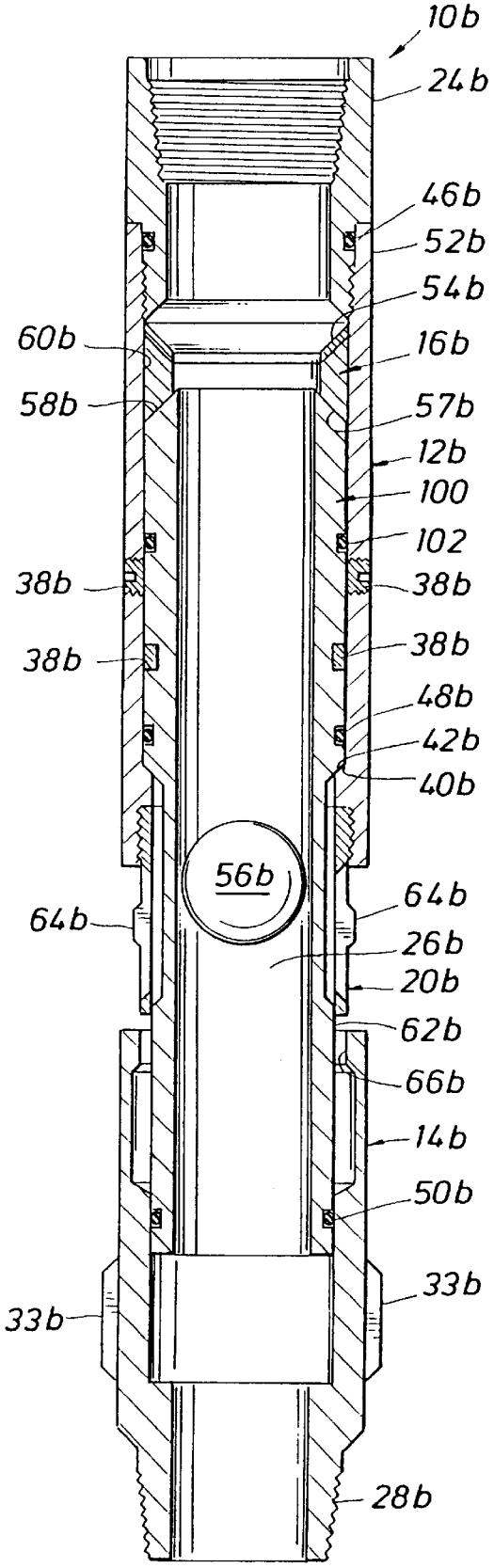

Illustrated in FIGS. 4A and 4B is an apparatus 10*b* which is another modified form of the apparatus 10 shown in FIGS. 1A–2B. Elements of apparatus 10*b* which are similar to those elements previously described are indicated in FIGS. 4A and 4B with the same reference numerals, but with an added suffix "b".

Apparatus 10*b* functions similar to apparatus 10, the major difference being that there are no ports 30 and 32 and no plug 18. The flow passage 26*b* extends axially through the apparatus 10*b,* permitting flow therethrough at all times, except for when ball 56*b* is dropped or pumped down to ball seat 16*b* and engages seal surface 54*b*. Circumferential seal 102 sealingly engages sleeve 100 and upper housing 12*b* and is disposed axially intermediate shear pins 38*b* and upper connector 24*b*.

The sleeve 100 is shifted downward by pumping or dropping ball 56*b* into the apparatus 10*b* so that the ball 56*b* sealingly engages the ball seat 16*b*. A predetermined pressure is created across the ball seat 16*b,* shearing shear pins 38*b*. The ball seat 16*b* then expands radially outward and ball 56*b* is permitted to pass through flow passage 26*b*.

When sleeve 100 is downwardly shifted, as shown in FIG. 4B, collets 20*b* are no longer radially outwardly biased by enlarged outer diameter 62*b*. The upper housing 12*b* may then be separated from lower housing 14*b*. Thus, apparatus 10*b* is useful in circumstances in which it is desired to run the apparatus into the wellbore with no fluid communication between the flow passage 26*b* and the wellbore external to the apparatus 10*b,* or when such fluid communication is otherwise provided, and then to separate the upper housing 12*b* from the lower housing 14*b*.

Figure 5A:
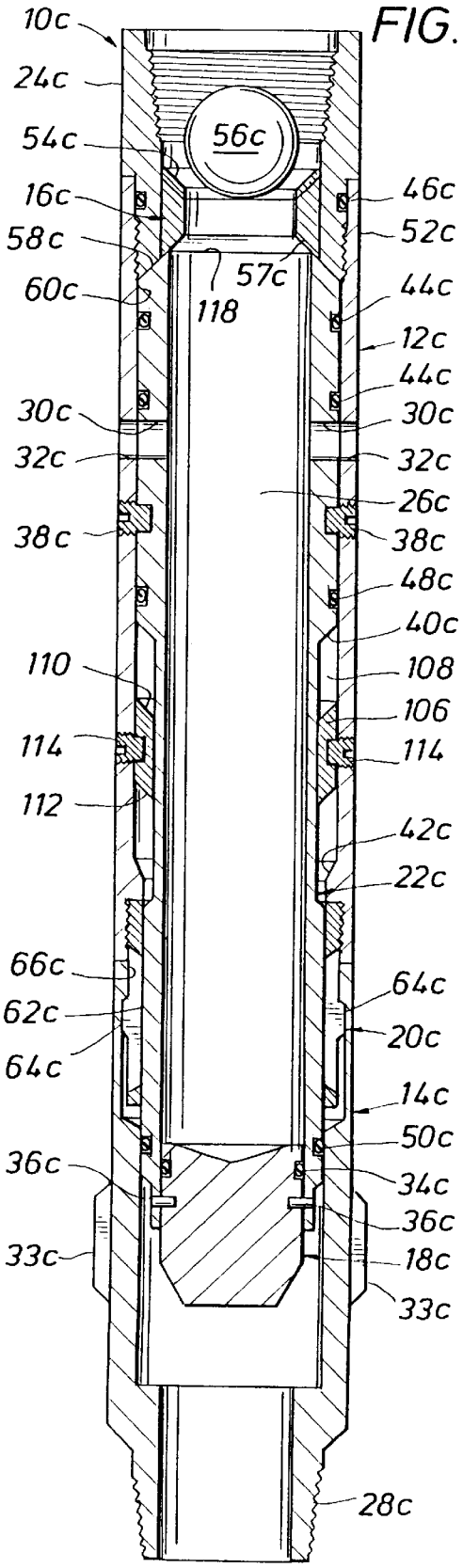
FIGS. 5A–5C are cross-sectional views of a fourth apparatus embodying principles of the present invention.
Figure 5B:
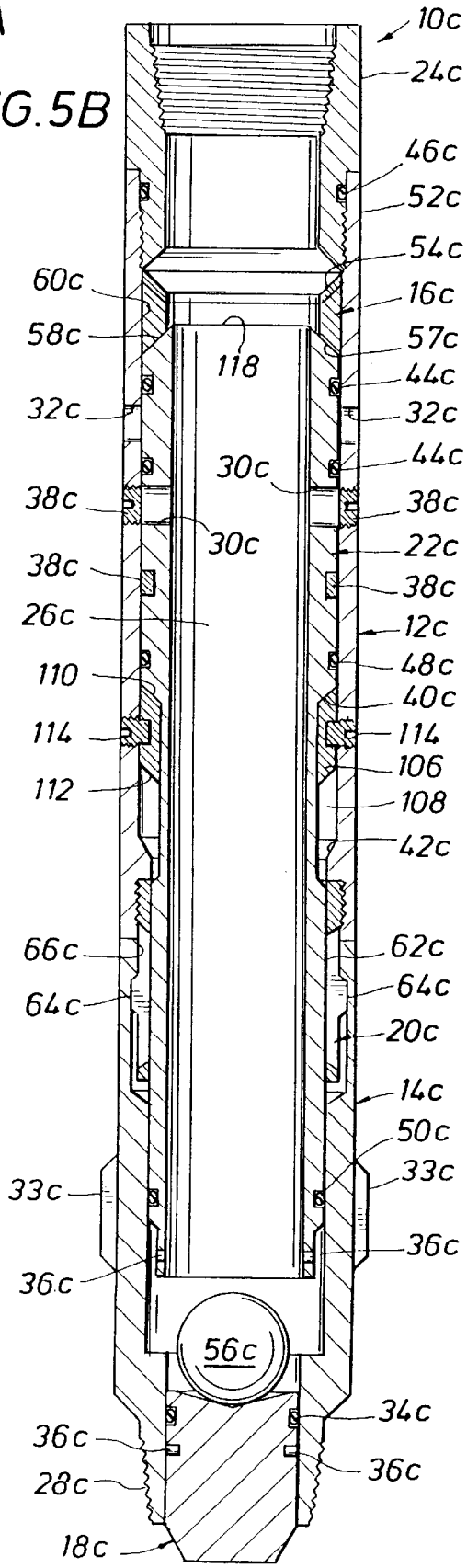
Figure 5C:
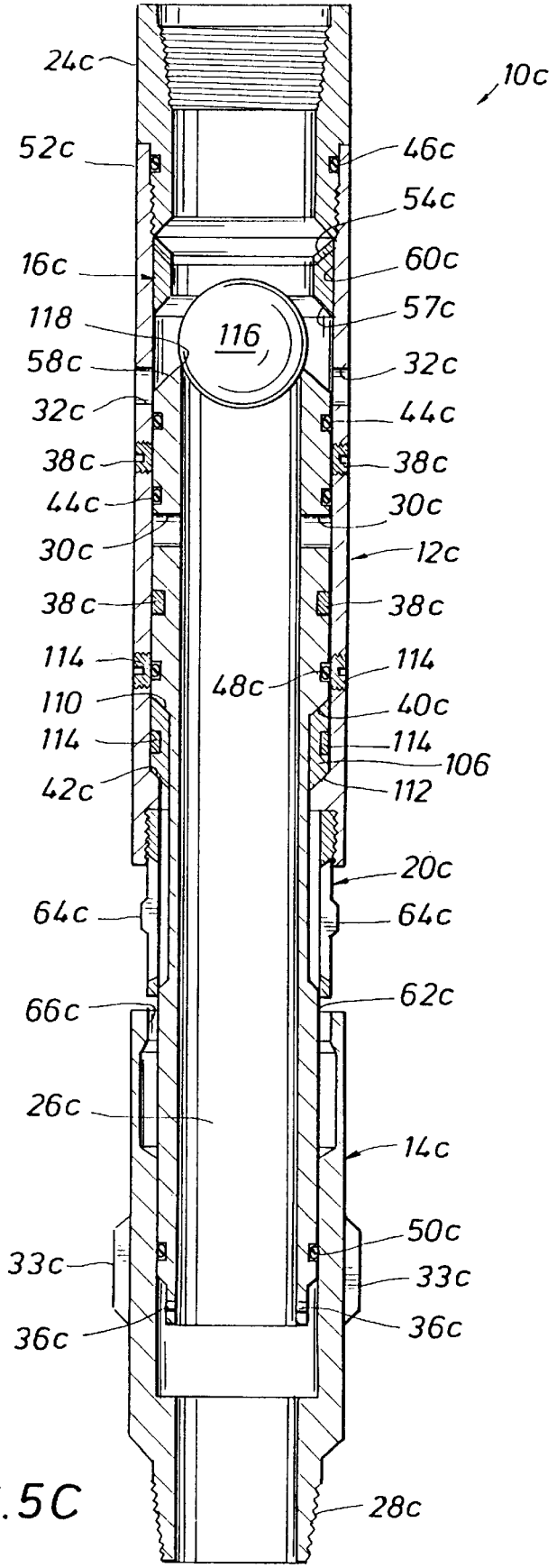

FIGS. 5A–5C show an apparatus 10*c* which is yet another modified form of the apparatus 10 shown in FIGS. 1A–2B. Elements of apparatus 10*c* which are similar to those elements previously described are indicated in FIGS. 5A–5C with the same reference numerals, but with an added suffix "c".

Apparatus 10*c* functions similar to apparatus 10, the major difference being the inclusion of annular ring 106 in annular space 108 axially intermediate sloping surfaces 40*c* and 42*c,* and radially intermediate the sleeve 22*c* and upper housing 12*c*. Annular ring 106 has upper and lower radially sloping surfaces 110 and 112, respectively, and is releasably secured by shear pins 114 against axial movement relative to the upper housing 12*c*. As will be readily appreciated by consideration of the following description, annular ring 106 permits the steps of closing the ports 32*c* and separating the housings 12*c* and 14*c* to be performed separately.

When the sleeve 22*c* is downwardly shifted, as shown in FIG. 5B, ports 32*c* are closed, preventing fluid communication between the flow passage 26*c* and the wellbore external to the apparatus 10*c*. In this configuration of the apparatus 10*c,* sloping shoulder 40*c* on sleeve 22*c* is in contact with sloping shoulder 110 of annular ring 106. The ball seat 16*c* is expanded radially outward, permitting the ball 56*c* to pass through the flow passage 26*c*. Plug 18*c* and ball 56*c* may be expelled from the sleeve 22*c* by creating a sufficient differential pressure across the plug to shear shear pins 36*c*. However, unlike apparatus 10 as shown in FIG. 1B, the upper housing 12*c* may not be separated from the lower housing 14*c* with the apparatus 10*c* in the configuration shown in FIG. 5B, because the collets 20*c* remain radially outwardly biased by outer diameter 62*c* on the sleeve 22*c*.

In order to separate upper housing 12*c* from lower housing 14*c,* a second ball 116 is dropped or pumped down into the apparatus 10*c*. The ball 116 has a larger diameter than the first ball 56*c,* but is still able to pass through the expanded ball seat 16*c* as shown in FIG. 5C. The ball 116 has a diameter which is, however, too large to pass through the sleeve 22*c*. Instead, the ball 116 sealingly engages a circumferential seal surface 118 on the sleeve 22*c,* disposed adjacent the sloping surface 58*c*. A pressure differential may now be created across the ball 116 to downwardly bias the sleeve 22*c* and shear shear pins 114. The sleeve 22*c* and annular ring 106 may then shift downwardly until sloping shoulder 112 contacts sloping shoulder 42*c*. When the sleeve 22*c* is thus further shifted downwardly, outer diameter 62*c* no longer radially outwardly biases the collets 20*c* and the upper housing 12*c* may be separated from the lower housing 14*c*. Additionally, ports 32*c* are again opened, permitting fluid communication between the wellbore and the apparatus 10*c* interior above the ball 116.

In a preferred mode of operation, the apparatus 10*c* is installed between the production tubing and the sand control screen as described above. During the gravel pack operation, gravel is pumped down through the tubing and into flow passage 26*c*. The gravel exits through the aligned ports 30*c* and 32*c* and flows into the wellbore. When the gravel pack operation is completed, the ball 56*c* is dropped or pumped down through the tubing to the ball seat 16*c*. Pressure is applied to the tubing at the surface until a first predetermined pressure differential is created across the ball seat 16*c,* shearing the shear pins 38*c* and forcing the sleeve 22*c* to shift downward. At this point, ports 32*c* are closed, preventing fluid communication between the wellbore and the flow passage 26*c*. The ball 56*c* passes through the ball seat 16*c*. A second predetermined pressure differential is then created across the plug 18*c* by applying pressure to the tubing at the earth's surface, thereby shearing shear pins 36*c,* and expelling the plug 18*c* and the ball 56*c* from the sleeve 22*c*. The well may then go into production, with fluids flowing from the formation, through the gravel pack, through the screen, and upwardly through the flow passage 26*c* and the tubing to the earth's surface. If it is later desired to remove the tubing from the wellbore without displacing or otherwise disturbing the screen and gravel pack, a second ball 116 is dropped or pumped down the tubing and a third predetermined pressure differential is created across the ball to shear shear pins 114. The sleeve 22*c* then shifts further downwardly, permitting the collets 20*c* to flex radially inward. The tubing may then be removed from the wellbore, any fluid remaining in the tubing being able to flow out of the re-opened ports 32*c* into the wellbore during the tubing's removal.

Thus, apparatus 10*c* is useful in circumstances in which it is desired to run the apparatus into the wellbore with ports 32*c* initially open, perform the gravel pack operation, close the ports, and expel the plug 18*c* and ball 56*c* before putting the well into production, but it is not desired to concurrently release the upper housing 12*c* for separation from the lower housing 14*c*. This permits the tubing, apparatus 10*c,* and screen to later be removed from the wellbore together (the upper and lower housings 12*c* and 14*c,* respectively, remaining attached), or, if it is desired to remove the tubing, but not the screen, from the wellbore, the second ball 116 may be dropped or pumped down through the tubing to separate the upper and lower housings 12*c* and 14*c,* respectively.

Figure 6A:
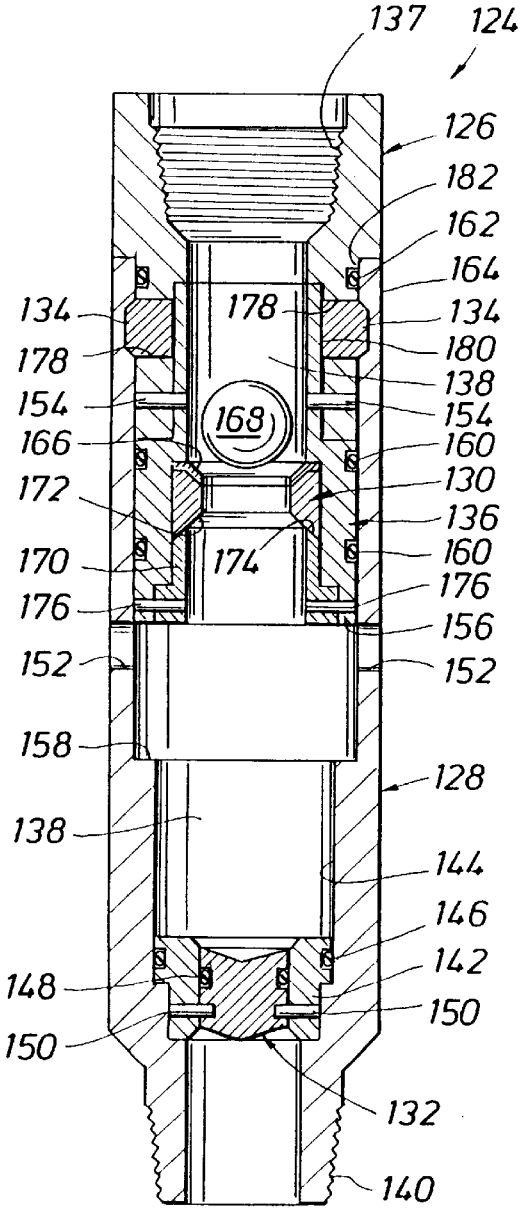
FIGS. 6A–6B are cross-sectional views of a sixth apparatus embodying principles of the present invention.
Figure 6B:
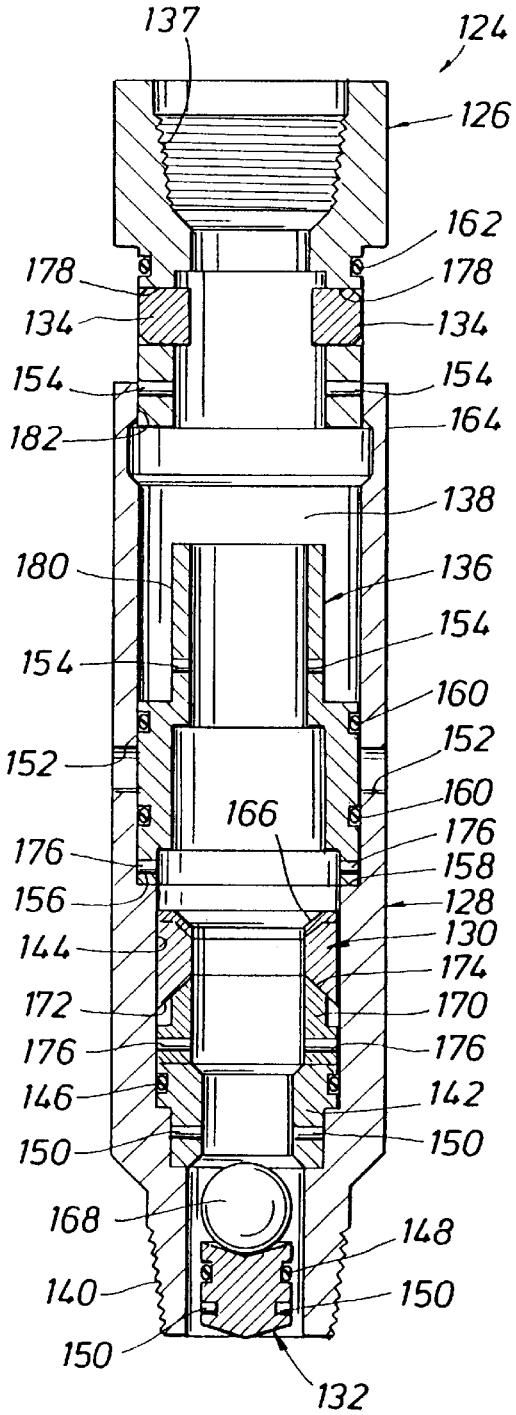

FIGS. 6A and 6B show another apparatus 124 embodying principles of the present invention. The apparatus 124 includes an upper housing 126, a lower housing 128, an expandable ball seat 130, a plug 132, collets or lugs 134, and a sleeve 136. FIG. 6A shows the apparatus 124 in a configuration in which it is run into the wellbore prior to the gravel pack operation. FIG. 6B shows the apparatus 124 in a configuration subsequent to the gravel pack operation. Comparing FIG. 6B to FIG. 6A, note that the expandable ball seat 130 has expanded radially outward within the lower housing 128, the sleeve 136 has been shifted downward within the lower housing, the plug 132 has been ejected, and the lower housing 128 has separated from the upper housing 126.

When initially run into the wellbore prior to the gravel pack operation, as shown in FIG. 6A, the apparatus 124 is installed between the production tubing and the sand control screen. The tubing is threadedly and sealingly attached to the upper housing 126 threaded connection 137. An interior axial flow passage 138 is thus placed in fluid communication with the interior of the production tubing. The screen is threadedly and sealingly attached to the lower housing 128 at threaded connection 140. Plug 132 is retained in an annular sleeve 142 disposed in an inner diameter 144 of lower housing 128 and prevents fluid communication between the interior of the production tubing and the interior of the screen via the flow passage 138. Circumferential seal 146 sealingly engages the annular sleeve 142 and inner diameter 144.

The plug 132 prevents gravel, pumped down the tubing from the earth's surface, from filling the interior of the sand screen during the gravel pack operation. The plug 132 is later ejected, as shown in FIG. 6B, to permit flow of fluids from the interior of the screen, through the flow passage 138, and into the production tubing for transport to the earth's surface. A circumferential seal 148 sealingly engages the plug 132 and sleeve 142 and permits a pressure differential to be created across the plug to shear shear pins 150 which extend radially through the sleeve 142 and into the plug.

Radially extending ports 152 formed through the lower housing 128 are initially open, as shown in FIG. 6A, permitting fluid communication between the flow passage 138 and the wellbore external to the apparatus 124. During the gravel pack operation, gravel may be pumped through the ports 152 and into the annular area between the screen and the casing.

Shear pins 154, extending radially through the upper housing 126 and the sleeve 136, releasably secure the sleeve against axial movement relative to the upper housing. When shear pins 154 are sheared, sleeve 136 is permitted to move downwardly until shoulder 156 on the sleeve 136 contacts shoulder 158 formed on the lower housing 128.

When sleeve 136 has been downwardly shifted, as shown in FIG. 6B, circumferential seals 160 straddle the ports 152 on the lower housing 128 and prevent fluid communication between the flow passage 138 and the wellbore external to the apparatus 124. Circumferential seal 162 sealingly engages the upper housing 126 and an upper end 164 of the lower housing 128, also preventing fluid communication between the flow passage 138 and the wellbore external to the apparatus 124.

Sleeve 136 is downwardly shifted within the lower housing 128 by a first predetermined pressure differential created across the expandable ball seat 130. The expandable ball seat 130 is of conventional construction and is in a radially compressed configuration, as viewed in FIG. 6A, when installed into the sleeve 136. Upwardly facing seal surface 166 on the ball seat 130, when in the radially compressed configuration, is smaller in diameter and is thus capable of sealingly engaging a ball 168 dropped or pumped down through the production tubing. It is to be understood that the ball 168 would preferably not be dropped through the production tubing during the gravel pack operation as it would interfere with the pumping of gravel through the apparatus 124. The ball 168 is preferably dropped through the production tubing when the gravel pack operation has been completed and it is desired to shift the sleeve 136 to close ports 152.

When the ball 168 sealingly engages the seal surface 166, a pressure differential may be created across the ball seat 130 by applying pressure to the interior of the production tubing at the earth's surface. Such a pressure differential downwardly biases the ball seat 130 against a ring 170, forcing radially sloping surface 172 formed on the ball seat 130 against radially sloping surface 174 on the ring. The contact between the sloping surfaces 172 and 174 further biases the ball seat 130 radially outward. The ring 170 is releasably secured against axial movement within the sleeve 136 with shear pins 176 extending radially through the sleeve and the ring.

When a first predetermined pressure differential has been created across the ball seat 130, shear pins 154 shear, permitting the sleeve 136 to downwardly shift, as described above. Lower housing 128 is initially coaxially attached to the upper housing 126, as shown in FIG. 6A, with lugs 134 which are installed radially through openings 178 formed on the upper housing. Radially reduced outer diameter 180 on the sleeve 136 biases the lugs 134 radially outward so that they are radially larger than reduced inner diameter 182 on the lower housing 128. When, however, the sleeve 136 has been downwardly shifted, as shown in FIG. 6B, the lugs 134 are no longer radially outwardly biased by diameter 180 on the sleeve, and the lugs are permitted to displace radially inward. Inner diameter 182 on the lower housing 128 may then pass over the lugs 134, permitting the lower housing to separate from the upper housing 126.

Application of a second predetermined differential pressure across the ball seat 130, greater than the first pressure differential, will then cause the shear pins 176 to shear and permit the ball seat and ring 170 to downwardly shift and move axially into the inner diameter 144 of the lower housing 128, as shown in FIG. 6B. The ball seat 130 is thus permitted to expand radially outward into the inner diameter 144. Such expansion of the ball seat 130 causes the seal surface 166 to have a diameter larger than that of the ball 168, which permits the ball to pass through the ball seat and the flow passage 138 to the plug 132. Thus, when the plug 132 is later expelled from the annular sleeve 142, as shown in FIG. 6B and described above, the ball 168 will also be expelled.

In a preferred mode of operation, the apparatus 124 is installed between the production tubing and the sand control screen as described above. During the gravel pack operation, gravel is pumped down through the tubing and into flow passage 138. The gravel exits through the ports 152 and flows into the wellbore. When the gravel pack operation is completed, the ball 168 is dropped or pumped down through the tubing to the ball seat 130. Pressure is applied to the tubing at the surface until a first predetermined pressure differential is created across the ball seat 130, shearing the shear pins 154 and forcing the sleeve 136 to shift downward. At this point, ports 152 are closed, preventing fluid communication between the wellbore and the flow passage 138, and lugs 134 are no longer biased radially outward. A second predetermined pressure differential is then created across the ball seat 130, causing the shear pins 176 to shear and forcing the ring 170 and ball seat 130 to shift downward into diameter 144 of the lower housing 128 and permitting the ball seat to expand radially outward. The ball 168 passes through the expanded ball seat 130. A third predetermined pressure differential is then created across the plug 132 by applying pressure to the tubing at the earth's surface, thereby shearing shear pins 150, and expelling the plug 132 and the ball 168 from the sleeve 142. The tubing may then be removed from the wellbore when desired, without displacing or otherwise disturbing the screen or gravel pack.

The foregoing detailed description is to be clearly understood as being given by way of illustration and example only, the spirit and scope of the present invention being limited solely by the appended claims.

What is claimed is:

1. Apparatus operatively positionable in a subterranean wellbore, comprising:

generally tubular first and second housings;

a seat;

at least one radially extending projection;

a flow passage extending through said first and second housings;

a generally tubular sleeve maintaining said projection in a position securing said first housing against axial displacement relative to said second housing, and said sleeve permitting said projection to displace to a position in which relative axial displacement between the first and second housings is permitted when a first predetermined pressure differential is created across said seat, said seat expanding in response to the first pressure differential; and a port formed on said first housing and a port formed on said sleeve, said first housing port and said sleeve port being alignable to thereby permit fluid communication between said flow passage and an outer side surface of said first housing.

2. The apparatus according to claim 1, wherein said first housing port and said sleeve port are aligned before said first predetermined pressure differential is created across said seat.

3. The apparatus according to claim 2, wherein said sleeve further has first and second axially spaced apart circumferential seal members disposed thereon, said first and second seal members sealingly engaging said sleeve and said first housing, and said first and second seal members straddling said first housing port when said sleeve is axially displaced relative to said projection.

4. The apparatus according to claim 1, wherein said first housing port and said sleeve port are aligned after said sleeve is displaced relative to said projection.

5. Apparatus operatively positionable in a subterranean wellbore, comprising:

generally tubular first and second housings;

a seat;

at least one radially extending projection;

a flow passage extending through said first and second housings;

a generally tubular sleeve maintaining said projection in a position securing said first housing against axial displacement relative to said second housing, and said sleeve permitting said projection to displace to a position in which relative axial displacement between the first and second housings is permitted when a first predetermined pressure differential is created across said seat, said seat expanding in response to the first pressure differential; and a plug disposed within said flow passage, said plug preventing fluid communication through said flow passage.

6. The apparatus according to claim 5, further comprising a shear member releasably securing said plug against axial displacement relative to said sleeve, said shear member releasing said plug for axial displacement relative to said sleeve when a second predetermined pressure differential is created across said plug.

7. Apparatus operatively positionable in a subterranean wellbore, comprising:

generally tubular first and second housings;

a seat;

at least one engagement member;

a flow passage extending through said first and second housings;

a generally tubular sleeve maintaining said engagement member in a position securing said first housing against axial displacement relative to said second housing, and said sleeve displacing to a position in which expansion of the seat is permitted when a first predetermined pressure differential is created across said seat;

a seal surface formed on said sleeve; and a shear member releasably securing said sleeve against axial displacement relative to said first housing after said first predetermined pressure differential is created across said seat, said shear member releasing said sleeve for axial displacement relative to said first housing when a second predetermined pressure differential is created across said sleeve seal surface.

8. The apparatus according to claim 7, wherein said second predetermined pressure differential is greater than said first predetermined pressure differential, and wherein said sleeve seal surface has an inner diameter greater than an inner diameter of said seat.

9. Apparatus operatively positionable in a subterranean wellbore axially intermediate tubing extending to the earth's surface and a sand control screen, the apparatus comprising:

an upper tubular member having inner and outer side surfaces and first and second opposite ends, said upper tubular member first end being capable of attachment to the tubing;

a lower tubular member having inner and outer side surfaces and first and second opposite ends, said lower tubular member second end being capable of attachment to the sand control screen;

a collet member disposed radially inward relative to said upper and lower tubular member inner side surfaces, said collet member being attached to one of said upper tubular member second end and said lower tubular member first end, and said collet member having a projection formed thereon, said projection extending radially outwardly and engaging a radially enlarged inner diameter portion of the other one of said upper tubular member second end and said lower tubular member first end;

a tubular sleeve having a radially extending port formed therethrough, inner and outer side surfaces, and a radially enlarged portion formed on said sleeve outer side surface, said sleeve radially enlarged portion being disposed radially inwardly adjacent said collet member and radially outwardly biasing said projection, and said sleeve inner side surface defining a flow passage therethrough;

an expandable ball seat disposed adjacent said sleeve, such that when a pressure differential is created across said ball seat, said ball seat biases said sleeve for axial displacement relative to said collet member, said ball seat expanding when said sleeve is displaced axially relative to said collet member; and a first shear member releasably securing said sleeve against axial displacement relative to said collet member, said first shear member releasing said sleeve for axial displacement relative to said collet member when a first predetermined pressure differential is created across said ball seat.

10. The apparatus according to claim 9, further comprising first and second radially extending flow ports formed through said sleeve and one of said upper and lower tubular members, respectively, said first and second ports permitting fluid communication between said flow passage and one of said upper and lower tubular member exterior side surfaces.

11. The apparatus according to claim 10, wherein said first and second ports permit fluid communication between said flow passage and one of said upper and lower tubular member exterior side surfaces when said sleeve has axially displaced relative to said collet member.

12. The apparatus according to claim 9, further comprising a plug, said plug being disposed axially intermediate said upper tubular member first end and said lower tubular member second end, and a second shear member, said second shear member releasably securing said plug against axial displacement relative to said sleeve, said second shear member releasing said plug for axial displacement relative to said sleeve when a second predetermined pressure differential is created across said plug.

13. The apparatus according to claim 9, further comprising a seal surface formed on an end of said sleeve, and a third shear member, said third shear member releasably securing said sleeve against axial displacement relative to said collet member, said third shear member releasing said sleeve for axial displacement relative to said collet member when a third predetermined pressure differential is created across said seal surface.

14. Apparatus operatively positionable within a subterranean well, the apparatus comprising:

first and second housings having a flow passage formed generally axially therethrough, and one of the first and second housings having a port formed through a sidewall portion thereof;

at least one engagement member releasably securing the first housing against displacement relative to the second housing;

a support member disposed in a first position in which the support member biases the engagement member to secure the first housing against displacement relative to the second housing, and the support member having a port formed through a sidewall portion thereof, the support member port being fluid communicable with the port formed through the one of the first and second housings; and an expandable seal member operative to displace the support member to a second position in which the engagement member is permitted to release the first housing for displacement relative to the second housing, the expandable seal member expanding when the support member displaces from the first position to the second position.

15. The apparatus according to claim 14, wherein the at least one engagement member is a series of circumferentially spaced apart collets attached to one of the first and second housings.

16. The apparatus according to claim 14, wherein the support member is a sleeve axially reciprocably disposed within at least one of the first and second housings.

17. The apparatus according to claim 14, wherein the expandable seal member is a ball seat.

18. The apparatus according to claim 17, wherein the ball seat is cooperatively engaged with the support member to thereby expand the ball seat when a predetermined pressure differential is applied across the ball seat.

19. Apparatus operatively positionable within a subterranean well, the apparatus comprising:

first and second generally tubular housings, one of the first and second housings having a port formed through a sidewall portion thereof;

a flow passage formed through the first and second housings;

a valve mechanism selectively permitting and preventing fluid flow through the flow passage;

a release mechanism interconnected to the valve mechanism, the release mechanism selectively preventing relative displacement between the first and second housings and permitting relative displacement between the first and second housings when the valve mechanism is actuated, and the release mechanism further selectively permitting and preventing fluid communication between the flow passage and the port; and wherein the valve mechanism includes a radially outwardly expandable seat in a radially compressed configuration thereof, the seat being reciprocably disposed within the flow passage, and a member configured for sealing engagement with the seat, the member blocking fluid flow through the flow passage when sealingly engaged with the seat, and the seat displacing relative to the flow passage and expanding in response to such displacement, thereby expelling the member and permitting fluid flow through the flow passage, when a predetermined fluid pressure differential is applied across the seat and the member.

20. The apparatus according to claim 19, wherein the valve mechanism includes a seal member reciprocably disposed relative to the release mechanism.

21. The apparatus according to claim 20, wherein the seal member is expandable, the seal member radially expanding when the seal member displaces relative to the flow passage.

22. The apparatus according to claim 20, wherein the seal member is a ball seat.

23. The apparatus according to claim 20, wherein the seal member is engaged with the release mechanism.

24. The apparatus according to claim 23, wherein the seal member biases a portion of the release mechanism between a first position in which the release mechanism prevents relative displacement between the first and second housings and a second position in which the release mechanism permits relative displacement between the first and second housings when a predetermined fluid pressure differential is created across the seal member.

25. The apparatus according to claim 19, wherein the release mechanism includes a first member reciprocably disposed relative to the flow passage, the first member being biased by a second member of the valve mechanism to displace to a position in which relative displacement between the first and second housings is permitted when a predetermined fluid pressure differential is applied to the valve mechanism.

* * * * *